US009460899B2

(12) United States Patent
Kyushima et al.

(10) Patent No.: US 9,460,899 B2
(45) Date of Patent: Oct. 4, 2016

(54) PHOTOMULTIPLIER AND ITS MANUFACTURING METHOD

(71) Applicant: HAMAMATSU PHOTONICS K.K., Hamamatsu-shi, Shizuoka (JP)

(72) Inventors: Hiroyuki Kyushima, Hamamatsu (JP); Hideki Shimoi, Hamamatsu (JP); Akihiro Kageyama, Hamamatsu (JP); Keisuke Inoue, Hamamatsu (JP); Masuo Ito, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 14/841,886

(22) Filed: Sep. 1, 2015

(65) Prior Publication Data

US 2015/0371835 A1 Dec. 24, 2015

Related U.S. Application Data

(63) Continuation of application No. 14/136,236, filed on Dec. 20, 2013, now Pat. No. 9,147,559, which is a continuation of application No. 13/548,772, filed on Jul. 13, 2012, now Pat. No. 8,643,258, which is a (Continued)

(30) Foreign Application Priority Data

Feb. 17, 2004 (JP) ..... 2004-040405

(51) Int. Cl.

| | |
|---|---|
| ***H01J 43/04*** | (2006.01) |
| ***H01J 43/08*** | (2006.01) |
| ***H01J 43/24*** | (2006.01) |
| ***H01J 9/26*** | (2006.01) |

(52) U.S. Cl.
CPC ..... *H01J 43/08* (2013.01); *H01J 9/26* (2013.01); *H01J 43/04* (2013.01); *H01J 43/24* (2013.01)

(58) Field of Classification Search
CPC ..... H01J 43/04; H01J 43/06
USPC ..... 313/532, 540, 541, 542
See application file for complete search history.

(56) References Cited

U.S. PATENT DOCUMENTS

| | | | |
|---|---|---|---|
| 3,225,239 | A | 12/1965 | Thompson |
| 3,244,922 | A | 4/1966 | Wolfgang |

(Continued)

FOREIGN PATENT DOCUMENTS

| | | |
|---|---|---|
| EP | 1 211 713 | 6/2002 |
| GB | 503211 | 4/1939 |

(Continued)

*Primary Examiner* — Vip Patel
(74) *Attorney, Agent, or Firm* — Drinker Biddle & Reath LLP

(57) ABSTRACT

The present invention relates to a photomultiplier having a structure for making it possible to easily realize high detection accuracy and fine processing, and a method of manufacturing the same. The photomultiplier comprises an enclosure having an inside kept in a vacuum state, whereas a photocathode emitting electrons in response to incident light, an electron multiplier section multiplying in a cascading manner the electron emitted from the photocathode, and an anode for taking out a secondary electron generated in the electron multiplier section are arranged in the enclosure. A part of the enclosure is constructed by a glass substrate having a flat part, whereas each of the electron multiplier section and anode is two-dimensionally arranged on the flat part in the glass substrate.

14 Claims, 16 Drawing Sheets

Related U.S. Application Data continuation of application No. 13/113,604, filed on May 23, 2011, now Pat. No. 8,242,694, which is a continuation of application No. 10/589,602, filed as application No. PCT/JP2005/002298 on Feb. 16, 2005, now Pat. No. 7,977,878.

(56) References Cited

U.S. PATENT DOCUMENTS

| | | | |
|---|---|---|---|
| 3,374,380 | A | 3/1968 | Goodrich |
| 3,375,184 | A | 3/1968 | Giacopelli |
| 3,563,657 | A | 2/1971 | Kniseley et al. |
| 3,573,464 | A | 4/1971 | Miya |
| 3,883,335 | A | 5/1975 | Polaert |
| 4,149,106 | A | 4/1979 | de Wolf et al. |
| 4,482,836 | A | 11/1984 | Washington et al. |
| 5,264,693 | A | 11/1993 | Shimabukuro et al. |
| 5,329,110 | A | 7/1994 | Shimabukuro et al. |
| 5,493,111 | A | 2/1996 | Wheeler et al. |
| 5,568,013 | A | 10/1996 | Then et al. |
| 6,492,657 | B1 | 12/2002 | Burlefinger et al. |
| 6,989,632 | B2 | 1/2006 | Bach et al. |
| 7,049,747 | B1 | 5/2006 | Goodberlet et al. |
| 7,294,954 | B2 | 11/2007 | Syms |
| 2002/0079838 | A1 | 6/2002 | Bach et al. |
| 2004/0245925 | A1 | 12/2004 | Yamauchi et al. |

FOREIGN PATENT DOCUMENTS

| | | |
|---|---|---|
| JP | S50-16145 | 6/1975 |
| JP | 4-359855 | 12/1992 |
| JP | 5-144410 | 6/1993 |
| JP | 3078905 | 7/1993 |
| JP | 2000-40487 | 2/2000 |
| JP | 2000-113851 | 4/2000 |
| WO | WO 98/19341 | 5/1998 |

(a)

(b)

(a)

(b)

(a)

(b)

(a)

(b)

(a)

(b)

PHOTOMULTIPLIER AND ITS MANUFACTURING METHOD

This is a continuation application of copending application Ser. No. 14/136,236 having a filing date of Dec. 20, 2013, which is a continuation of application Ser. No. 13/548,772, now U.S. Pat. No. 8,643,258, having a filing date of Jul. 13, 2012 which is a continuation of application Ser. No. 13/113,604, now U.S. Pat. No. 8,242,694, having a filing date of May 23, 2011, which is a continuation of prior application Ser. No. 10/589,602, now U.S. Pat. No. 7,977,878, having a §371 date of Aug. 16, 2006, which is a national stage filing based on PCT International Application No. PCT/JP2005/002298, filed on Feb. 16, 2005. The copending application Ser. No. 14/136,236, and prior parent application Ser. Nos. 13/548,772, 13/113,604 and 10/589,602 are incorporated by reference herein in their entireties.

TECHNICAL FIELD

The present invention relates to a photomultiplier having an electron multiplier section which multiplies in a cascading manner photoelectrons generated by a photocathode, and a method of manufacturing the same.

BACKGROUND ART

Photomultipliers (PMT: Photo-Multiplier Tube) have conventionally been known as a photosensor. A photomultiplier comprises a photocathode for converting light into electrons, a focusing electrode, an electron multiplier section, and an anode, which are accommodated in a vacuum envelope. When light is incident on the photocathode in the photomultiplier, photoelectrons are emitted from the photocathode into the vacuum envelope. The photoelectron is guided to the electron multiplier section by the focusing electrode, and is multiplied in a cascading manner by the electron multiplier section. As a signal, the anode outputs electrons having arrived thereat among those multiplied (see the following Patent Documents 1 and 2).

Patent Document 1: Japanese Patent Publication No. 3078905

Patent Document 2: Japanese Patent Application Laid-Open No. HEI 4-359855

DISCLOSURE OF THE INVENTION

Problem to be Solved by the Invention

The inventors have studied conventional photomultipliers in detail, and as a result, have found problems as follows.

Namely, as photosensors have been widening the scope of their application, smaller photomultipliers have been in demand. On the other hand, as such a photomultiplier has thus been made smaller, high-precision processing techniques have been required for components constituting the photomultiplier. In particular, as members themselves are made finer, an accurate arrangement is hard to realize between the members, and fluctuations in detection accuracy among the photomultipliers manufactured become greater.

In order to overcome the above-mentioned problems, it is an object of the present invention to provide a photomultiplier having a structure which can achieve a smaller size more easily than conventional cases while in a state keeping a high detection accuracy and is easy to process finely, and a method of manufacturing the same.

Means for Solving Problem

The photomultiplier according to the present invention is a photosensor having an electron multiplier section for multiplying in a cascading manner photoelectrons generated by a photocathode, and encompasses, depending on the position where the photocathode is arranged, a photomultiplier having a transmission-type photocathode which emits the photoelectrons in the same direction as the incident direction of light, and a photomultiplier having a reflection-type photocathode which emits photoelectrons in a direction different from the incident direction of light.

In particular, the photomultiplier comprises an enclosure keeping the inside of the photomultiplier in a vacuum state, a photocathode accommodated in the enclosure, an electron multiplier section accommodated in the enclosure, and an anode at least partly accommodated in the enclosure. The enclosure has at least a part constructed by a glass substrate having a flat part. The photocathode emits photoelectrons to the inside of the enclosure according to light captured through the enclosure. The electron multiplier section is arranged on a predetermined area of the flat part in the glass substrate, and multiplies in a cascading manner the photoelectrons emitted from the photocathode. The anode is arranged on an area excluding the area where the electron multiplier section is arranged on the flat part in the glass substrate, and functions as an electrode which takes out electrons having arrived thereat among electrons multiplied in a cascading manner in the electron multiplier section as a signal. Thus, the electron multiplier section and anode are arranged two-dimensionally on the flat part in the glass substrate, whereby the apparatus as a whole can be made smaller.

Preferably, the enclosure comprises a lower frame which is the glass substrate, an upper frame opposing the lower frame, and a side wall frame which is provided between the upper and lower frames and has a form surrounding the electron multiplier section and anode. It will be preferred in particular if the side wall frame is integrally formed with the electron multiplier section and anode by etching one silicon substrate. Such a structure can easily realize fine processing, thus yielding a photomultiplier having a smaller size. In this case, the electron multiplier section and anode integrally formed with the side wall frame are also comprised of a silicon material. Preferably, the electron multiplier section and anode are fixed to the glass substrate by a method other than welding. It will be preferred, for example, if the electron multiplier section and anode comprised of a silicon material are fixed to the glass substrate by any of anodic bonding and diffusion bonding. The side wall frame and the glass substrate (lower frame) are joined to each other by any of anodic bonding and diffusion bonding as a matter of course. Such fixation by anodic bonding or diffusion bonding can minimize troubles such as the occurrence of foreign matters at the time of welding and the like.

The electron multiplier section has a plurality of grooves extending such that electrons run along a direction intersecting, a direction in which the photocathode emits the photoelectrons. Since the grooves in the electron multiplier section extend such that the electron runs along a direction intersecting the direction in which the photocathode emits the photoelectrons, a smaller size can be attained as compared with a structure in which an electron multiplier section is formed along a direction in which the photocathode emits the photoelectrons.

In the photomultiplier according to the present invention, the electron multiplier section causes electrons to collide against each of a pair of side walls defining each groove, thereby effecting a cascade multiplication. Causing electrons to collide against each of a pair of side walls defining each groove effects a more efficient cascade multiplication. Preferably, in the photomultiplier according to the present invention, each side wall defining the groove is provided with a protrusion. Providing the side wall with the protrusion allows electrons to collide against the side wall by a predetermined distance, thereby enabling a more efficient cascade multiplication.

Preferably, in the photomultiplier according to the present invention, the electron multiplier section and anode are arranged on the flat part in the glass substrate while in a state separated by a predetermined distance from the side wall frame constituting a part of the enclosure. In this case, each of the electron multiplier section and anode can minimize the influence of external noise through the side wall frame, whereby a high detection accuracy can be obtained.

Preferably, in the photomultiplier according to the present invention, the upper frame is comprised of one of glass and silicon materials. When the upper frame is comprised of a glass material, it will be preferred if the upper frame is joined to the side wall frame by anodic bonding or diffusion bonding such that the upper frame and lower frame sandwich the side wall frame therebetween as in the joining of the glass substrate (lower frame) and side wall frame to each other. Thus, any of anodic bonding and diffusion bonding (the bonding of the lower frame and side wall frame and the bonding of the side wall frame and upper frame) vacuum-seals the enclosure, whereby the enclosure can be processed easily. The upper frame comprised of the glass material can function by itself as a transmitting window.

The upper frame may also be comprised of a silicon material. In this case, the upper frame is formed with a transmitting window in order to transmit therethrough a predetermined wavelength of light toward the photocathode accommodated in the enclosure. The side wall frame may be provided with the transmitting window as well.

A method of manufacturing the photomultiplier having the above-mentioned structure (the method of manufacturing a photomultiplier according to the present invention) initially prepares a lower frame, comprised of a glass material, constituting a part of the enclosure; a side wall frame constituting a part of the enclosure, the side wall frame being formed together with the electron multiplier section and anode by etching one silicon substrate; and an upper frame constituting a part of the enclosure.

Subsequently, the side wall frame is integrally fixed to the lower frame together with the electron multiplier section and anode by any of anodic bonding and diffusion bonding.

In the method of manufacturing a photomultiplier according to the present invention, the above-mentioned side wall frame is not required to be a silicon frame integrally formed with the electron multiplier section and anode. This manufacturing method is applicable to the manufacture of a photomultiplier which comprises an enclosure constructed by a lower frame, a side wall frame, and an upper frame, while having an inside kept in a vacuum state; a photocathode accommodated in the enclosure; an electron multiplier section accommodated in the enclosure; and an anode at least partly accommodated in the enclosure. First, in this case, each of a lower frame comprised of a glass material constituting a part of the enclosure, a side wall frame comprised of a silicon material constituting a part of the enclosure, and an upper frame constituting a part of the enclosure is prepared. Then, the side wall frame is joined to the lower frame by any of anodic bonding and diffusion bonding.

When the upper frame is comprised of a glass material here, the upper frame is joined to the side wall frame by any of anode bonding and diffusion bonding such that the upper frame and lower frame sandwich the side wall frame therebetween.

When the upper frame is comprised of a silicon material, on the other hand, the upper frame is formed with a transmitting window. The place where the transmitting window is formed is not limited to the upper frame, whereby the side wall frame may be formed with a transmitting window, for example.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

Effect of the Invention

The present invention yields a photomultiplier having a structure which can easily realize fine processing while in a state keeping a high detection accuracy.

DESCRIPTION OF THE REFERENCE NUMERALS

1*a* . . . photomultiplier; 2 . . . upper frame; 3 . . . side wall frame; 4 . . . lower frame (glass substrate); 22 . . . photocathode; 31 . . . electron multiplier section; 32 . . . anode; and 42 . . . anode terminal.

BEST MODES FOR CARRYING OUT THE INVENTION

In the following, embodiments of a photomultiplier and method of manufacturing the same according to the present invention will be explained in detail with reference to FIGS. 1 to 16. In the explanation of the drawings, constituents identical to each other will be referred to with numerals identical to each other without repeating their overlapping descriptions.

First Embodiment

Figure 1:
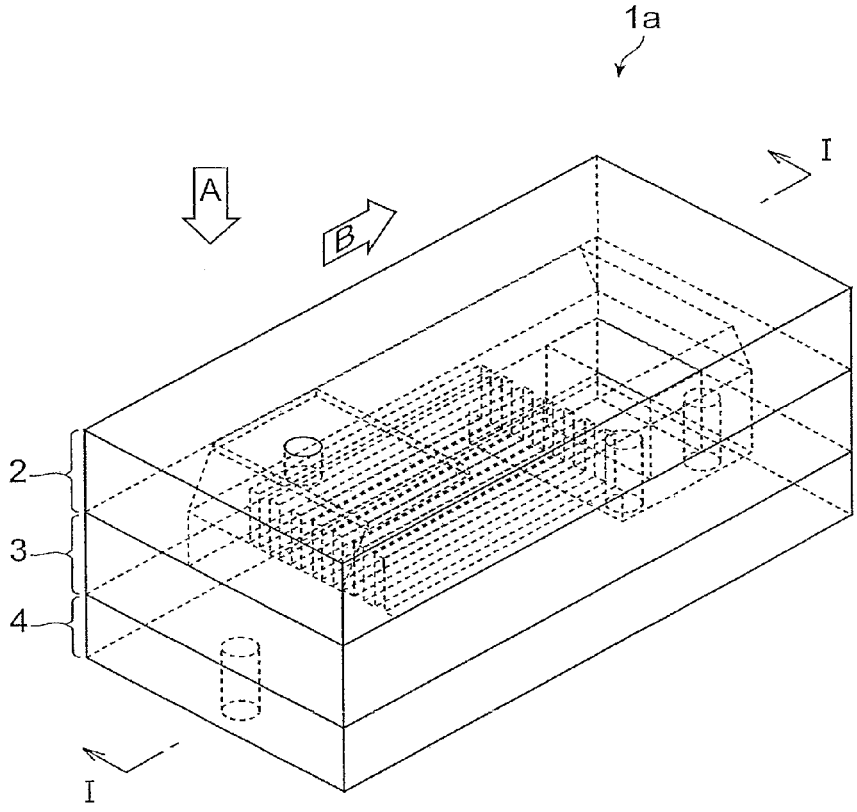
FIG. 1 is a perspective view showing the structure of a first embodiment (transmission type) of the photomultiplier according to the present invention.

FIG. 1 is a perspective view showing the structure of a first embodiment of the photomultiplier according to the present invention. The photomultiplier 1*a* according to the first embodiment, which is a transmission-type electron multiplier, comprises an enclosure constructed by an upper frame 2 (glass substrate), a side wall frame 3 (silicon substrate), and a lower frame 4 (glass substrate). The photomultiplier 1*a* is a photomultiplier in which, when light is incident on the photocathode in a direction intersecting an electron running direction in the electron multiplier section, i.e., when light is incident in the direction indicated by arrow A in FIG. 1, photoelectrons emitted from the photocathode are incident on the electron multiplier section and nm in the direction indicated by arrow B, whereby secondary electrons are multiplied in a cascading manner. The individual constituents will now be explained.

Figure 2:
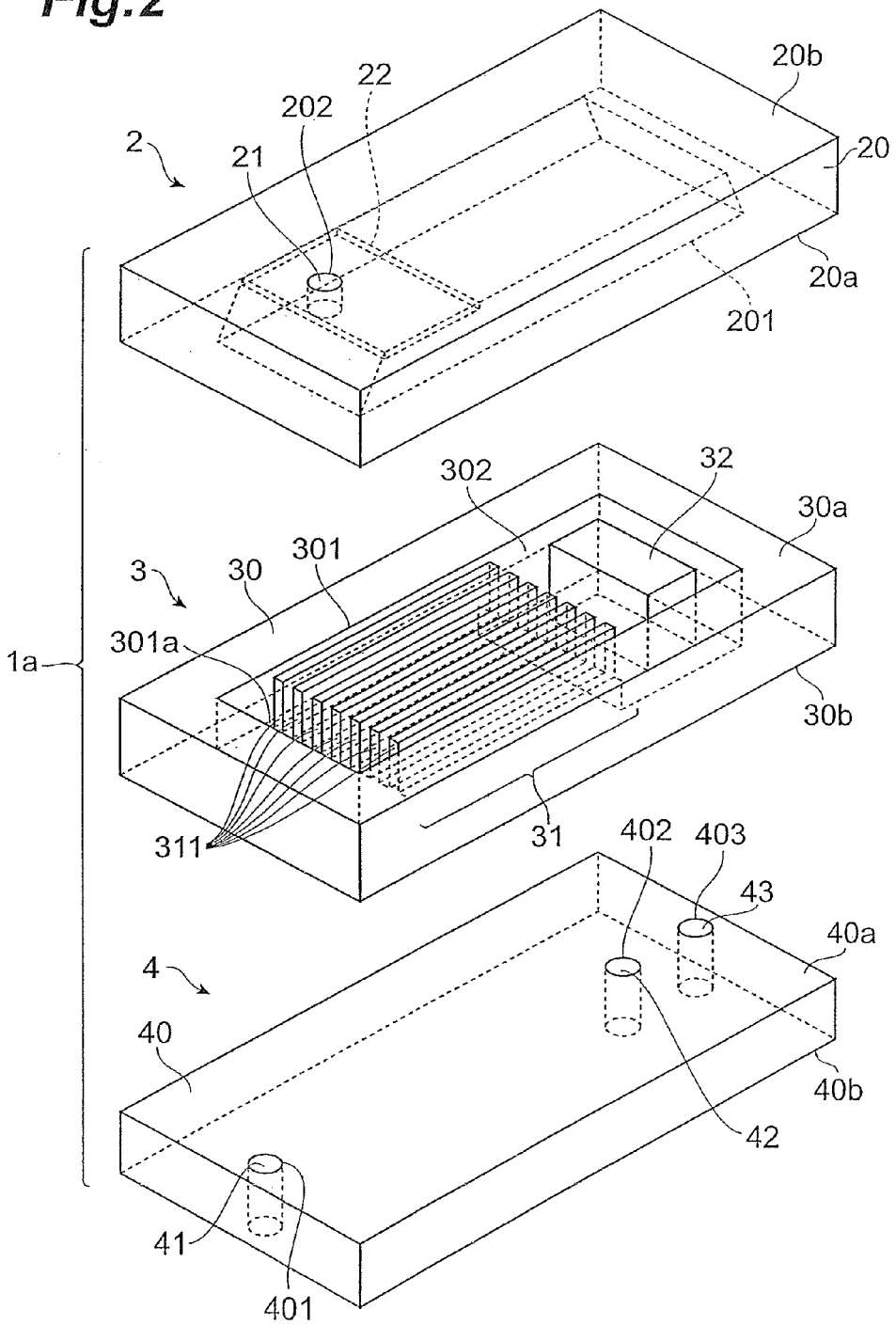
FIG. 2 is a view showing an assembling process of the photomultiplier according to the first embodiment shown in FIG. 1.

FIG. 2 is a perspective view showing the photomultiplier 1*a* shown in FIG. 1, while exploding it into the upper frame 2, side wall frame 3, and lower frame 4. The upper frame 2 is constructed by a rectangular flat glass substrate 20 as a base material. The main face 20*a* of the glass substrate 20 is formed with a rectangular depression 201, whereas the outer periphery of the depression 201 is formed in conformity to the outer periphery of the glass substrate 20. The bottom part of the depression is formed with a photocathode 22. The photocathode 22 is formed near one longitudinal end of the depression 201. The face 20*b* opposing the main face 20*a* of the glass substrate 20 is provided with a hole 202, which reaches the photocathode 22. A photocathode terminal 21 is arranged within the hole 202 and is in contact with the photocathode 22. In the first embodiment, the upper frame 2 comprised of a glass material functions by itself as a transmitting window.

The side wall frame 3 is constructed by a rectangular flat silicon substrate 30 as a base material. A depression 301 and a penetrating part 302 are formed from the main face 30*a* of the silicon substrate 30 toward its opposing face 30*b*. The depression 301 and penetrating part 302, each having a rectangular opening, are connected to each other, while their outer peripheries are formed in conformity to the outer, periphery of the silicon substrate 30.

An electron multiplier section 31 is formed within the depression 301. The electron multiplier section 31 has a plurality of wall parts 311 erected so as to extend along each other from the bottom part 301*a* of the depression 301. Thus, grooves are constructed between the wall parts 311. Side walls (side walls defining the grooves) of the wall parts 311 and the bottom part 301*a* are formed with secondary electron emitting surfaces comprised of a secondary electron emitting material. Each of the wall parts 311 is provided along the longitudinal axis of the depression 301, whereas its one end is arranged with a predetermined distance from one end of the depression 301, and the other end is arranged at a position reaching the penetrating part 302. An anode 32 is arranged within the penetrating part 302. The anode 32 is arranged with a gap from inner walls of the penetrating part 302, and is fixed to the lower frame 4 by anodic bonding or diffusion bonding.

The lower frame 4 is constructed by a rectangular flat glass substrate 40 as a base material. Holes 401, 402, and 403 are provided from the main face 40*a* of the glass substrate 40 toward its opposing face 40*b*. A photocathode-side terminal 41, an anode terminal 42, and an anode-side terminal 43 are inserted and fixed into the holes 401, 402, and 403, respectively. The anode terminal 42 is in contact with the anode 32 of the side wall frame 3.

Figure 3:
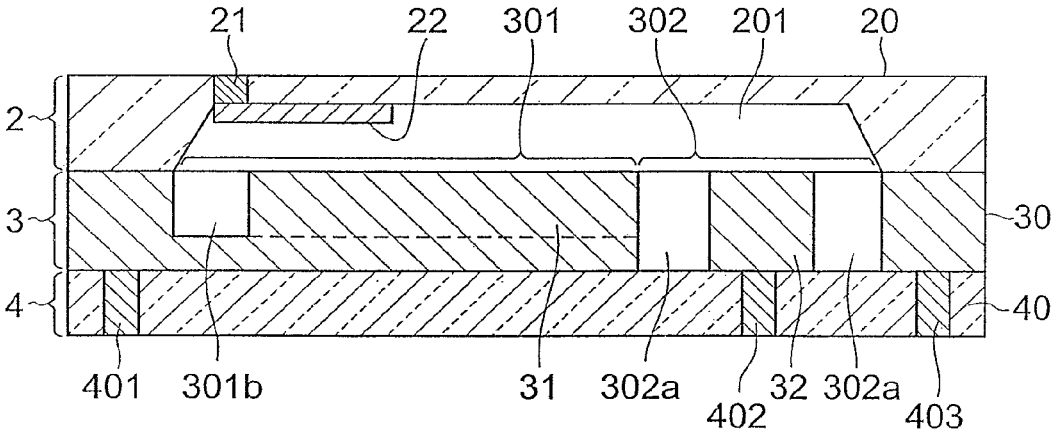
FIG. 3 is a sectional view showing the structure of the photomultiplier according to the first embodiment taken along the line in FIG. 1.

FIG. 3 is a sectional view showing the structure of the photomultiplier 1*a* according to the first embodiment taken along the line I-I in FIG. 1. As already explained, the bottom part in one end of the depression 201 in the upper frame 201 is formed with the photocathode 22. The photocathode terminal 21 is in contact with the photocathode 22, whereby a predetermined voltage is applied to the photocathode 22 through the photocathode terminal 21. The main face 20*a* (see FIG. 2) of the upper frame 2 and the main face 30*a* (see FIG. 2) of the side wall frame 3 are joined to each other by anodic bonding or diffusion bonding, whereby the upper frame 2 is fixed to the side wall frame 3.

The depression 301 and penetrating part 302 are arranged at a position corresponding to the depression 201 of the upper frame 2. The electron multiplier section. 31 is arranged in the depression 301 of the side wall frame 3, while a gap 301*b* is formed between one end wall of the depression 301 and the electron multiplier section 31. In this case, the electron multiplier section 31 of the side wall frame 3 is positioned directly under the photocathode 22 of the upper frame 2. The anode 32 is arranged within the penetrating part 302 of the side wall frame 3. The anode 32 is arranged so as to be out of contact with inner walls of the penetrating part 302, whereby a gap 302*a* is formed between the anode 32 and penetrating part 302. The anode 32 is fixed to the main face 40*a* (see FIG. 2) of the lower frame 4 by anodic bonding or diffusion bonding.

The face 30*b* (see FIG. 2) of the side wall frame 3 and the main face 40*a* (see FIG. 2) of the lower frame 4 are anodically bonded or diffusion-bonded to each other, whereby the lower frame 4 is fixed to the side wall frame 3.

At that time, the electron multiplier section 31 of the side wall frame 3 is also fixed to the lower frame 4 by anodic bonding or diffusion bonding. The upper frame 2 and lower frame 4, each comprised of a glass material, sandwiching the side wall frame 3 therebetween are joined to the side wall frame, whereby an enclosure of the photomultiplier 1*a* is obtained. A space is formed within the enclosure, whereas a vacuum airtight process is performed when assembling the enclosure constructed by the upper frame 2, side wall frame 3, and lower frame 4, so that the inside of the enclosure is kept in a vacuum state (as will be explained later in detail).

Since the photocathode-side terminal 401 and anode-side terminal 403 of the lower frame 4 are in contact with the silicon substrate 30 of the side wall frame 3, a potential difference can be generated in the longitudinal direction of the silicon substrate 30 (a direction intersecting a direction in which photoelectrons are emitted from the photocathode 22, i.e., a direction in which secondary electrons run in the electron multiplier section 31) when predetermined voltages are applied to the photocathode-side terminal 401 and the anode-side terminal 403, respectively. The anode terminal 402 of the lower frame 4 is in contact with the anode 32 of the side wall frame 3, and thus can take out electrons having arrived at the anode 32 as signals.

Figure 4:
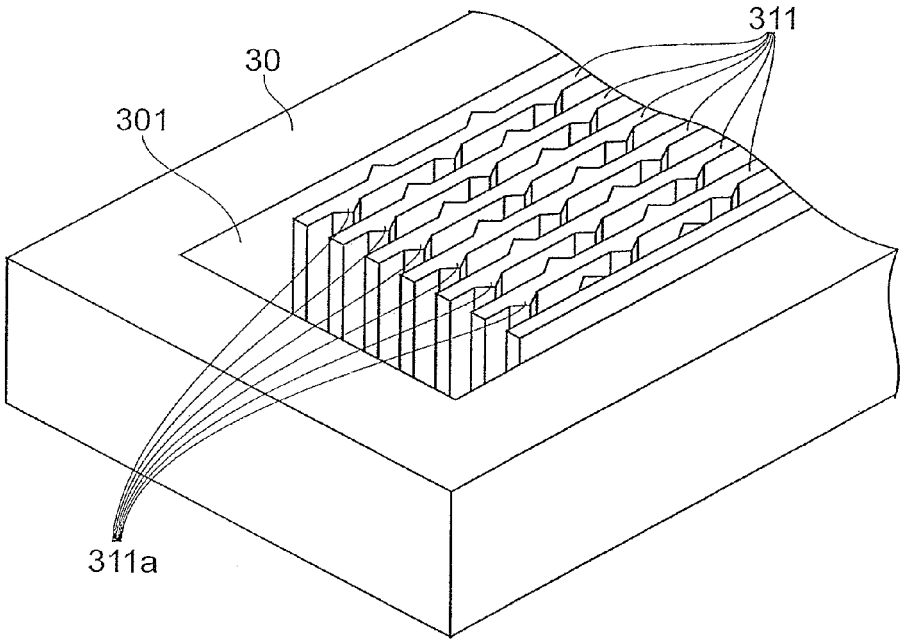
FIG. 4 is a perspective view showing the structure of the electron multiplier section in the photomultiplier according to the first embodiment.

FIG. 4 shows the structure of the side wall frame 3 near the wall parts 311. Side walls of the wall parts 311 arranged within the depression 301 of the silicon substrate 30 are formed with protrusions 311*a*. The protrusions 311*a* are alternately arranged on the opposing wall parts 311. The protrusions 311*a* are formed uniformly from the upper end to lower end of the wall parts 311.

The photomultiplier 1*a* operates as follows. Namely, voltages of −2000 V and 0 V are applied to the photocathode-side terminal 401 and anode-side terminal 403 of the lower frame 4, respectively. The resistance of the silicon substrate 30 is about 10 MΩ. The resistance value of the silicon substrate 30 can be adjusted by the volume of the silicon substrate 30, e.g., the thickness thereof. For example, reducing the thickness of the silicon substrate can increase the resistance value. When light is incident on the photocathode 22 here through the upper frame 2 comprised of a glass material, the photocathode 22 emits photoelectrons toward the side wall frame 3. Thus emitted photoelectrons reach the electron multiplier section 31 positioned directly under the photocathode 22. Since a potential difference is generated in the longitudinal direction of the silicon substrate 30, the photoelectrons having reached the electron multiplier section 31 are directed toward the anode 32. The electron multiplier section 31 is formed with grooves defined by a plurality of wall parts 311. Therefore, the photoelectrons having reached the electron multiplier section 31 from the photocathode 22 collide against the side walls of the wall parts 311 and the bottom part 301*a* between the opposing side walls 311, thereby emitting a plurality of secondary electrons. The electron multiplier section 31 successively performs cascade multiplications of the secondary electrons, thereby generating $10^5$ to $10^7$ secondary electrons per electron reaching the electron multiplier section from the photocathode. Thus generated secondary electrons reach the anode 32, and are taken out as signals from the anode terminal 402.

A method of manufacturing the photomultiplier according to the first embodiment will now be explained. When manufacturing the photomultiplier, a silicon substrate (a constituent material for the side wall frame 3 in FIG. 2) having a diameter of 4 inches and two glass substrates (constituent materials for the upper frame 2 and lower frame 4 in FIG. 3) having the same form are prepared. For each minute area (e.g., a square of several millimeters), they are subjected to a process which will be explained in the following. When the process explained in the following ends, the resulting product is divided into individual areas, whereby a photomultiplier is completed. The processing method will now be explained with reference to FIGS. 5 and 6.

Figure 5:
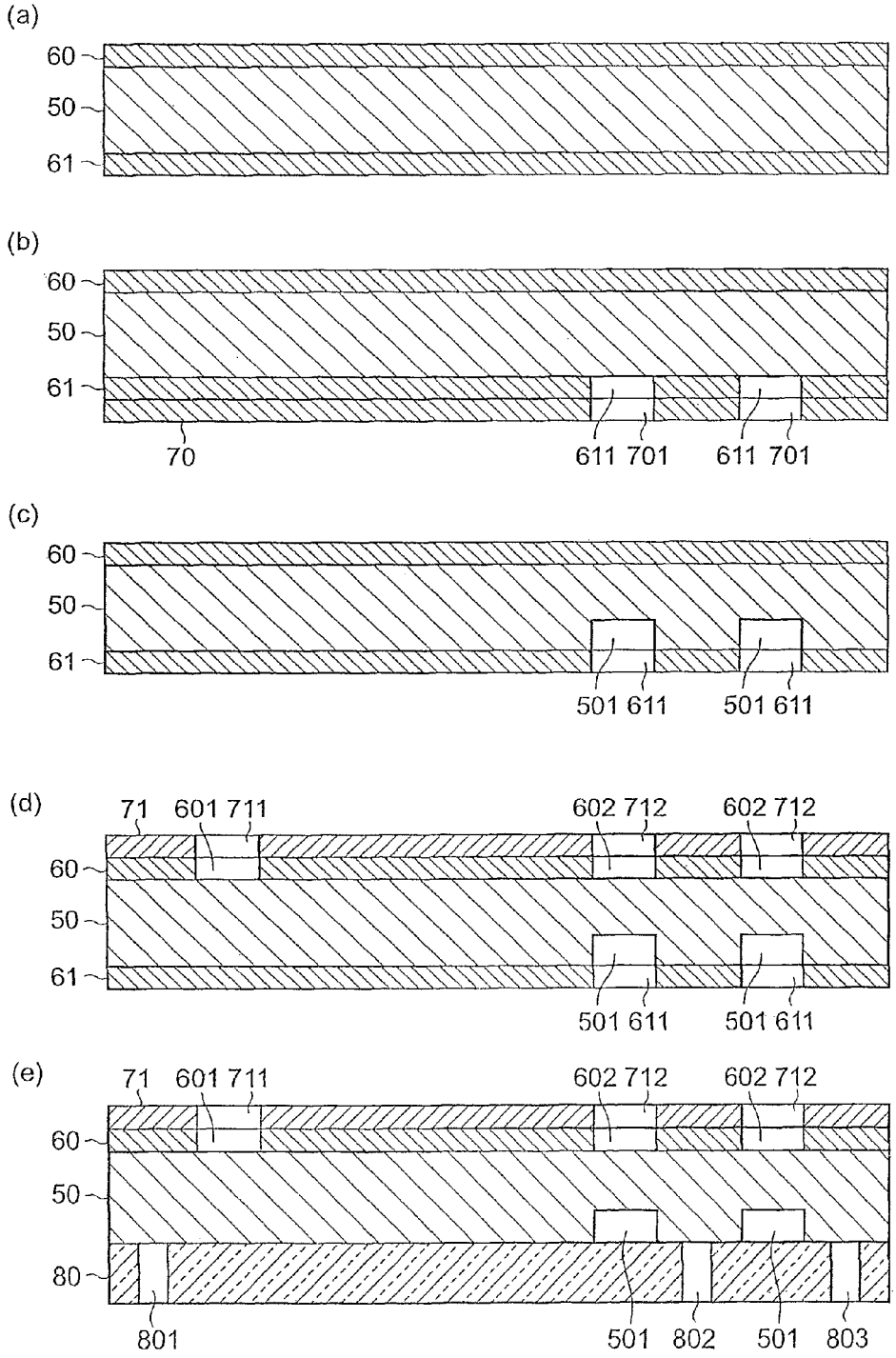
FIG. 5 is a (first) view for explaining a method of manufacturing the photomultiplier according to the first embodiment.

First, as shown in the area (a) of FIG. 5, a silicon substrate 50 (corresponding to the side wall frame 3) having a thickness of 0.3 mm and a resistivity of 30 kΩ·cm is prepared. Thermally-oxidized silicon films 60 and 61 are formed on both sides of the silicon substrate 50, respectively. The thermally-oxidized silicon films 60 and 61 function as masks at the time of DEEP-RIE (Reactive Ion Etching) processing. Subsequently, as shown in the area (b) of FIG. 5, a resist film 70 is formed on the rear side of the silicon substrate 50. The resist film 70 is formed with eliminating parts 701 corresponding to the gap between the penetrating part 302 and anode 32 in FIG. 2. When the thermally-oxidized silicon film 61 is etched in this state, eliminating parts 611 corresponding to the gap between the penetrating part 302 and anode 32 in FIG. 2 are formed.

After removing the resist film 70 from the state shown in the area (b) of FIG. 5, DEEP-RIE processing is performed. As shown in the area (c) of FIG. 5, the silicon substrate 50 is formed with gap parts 501 corresponding to the gap between the penetrating part 302 and anode 32 in FIG. 2. Subsequently, as shown in the area (d) of FIG. 5, a resist film 71 is formed on the front side of the silicon substrate 50. The resist film 71 is formed with an eliminating part 711 corresponding to the gap between the wall parts 311 and depression 301 in FIG. 2, and eliminating parts (not depicted) corresponding to the grooves between the wall parts 311. When the thermally oxidized silicon film 60 is etched in this state, an eliminating part 601 corresponding to the gap between the wall parts 311 and depression 301 in FIG. 2, eliminating parts 602 corresponding to the gap between the penetrating part 302 and anode 32 in FIG. 2, and eliminating parts (not depicted) corresponding to the grooves between the wall parts 311 in FIG. 2 are formed.

After removing the thermally oxidized silicon film 61 from the state of the area (d) in FIG. 5, a glass substrate 80 (corresponding to the lower frame 4) is anodically bonded to the rear side of the silicon substrate 50 (see the area (e) in FIG. 5). The glass substrate 80 has been processed beforehand with holes 801, 802, and 803 corresponding to the holes 401, 402, and 403, respectively. Subsequently, DEEP-RIE processing is performed on the front side of the silicon substrate 50. The resist film 71 functions as a mask material at the time of DEEP-RIE processing, thereby enabling processing with a high aspect ratio. After the DEEP-RIE processing, the resist film 71 and thermally oxidized silicon film 61 are removed. As shown in the area (a) of FIG. 6, a penetrating part reaching the glass substrate 80 is formed in the part processed beforehand with the gap part 501, whereby an island 52 corresponding to the anode 32 in FIG. 2 is formed. The island 52 corresponding to the anode 32 is fixed by anodic bonding to the glass substrate 80. At the time of DEEP-RIE processing, the groove part 51 corresponding to the grooves between the wall parts 311 in FIG. 2 and the depression 503 corresponding to the gap between the wall parts 311 and depression 301 in FIG. 2 are also formed. Here, the side walls of the groove part 51 and the bottom part 301*a* are formed with secondary electron emitting surfaces.

Subsequently, as shown in the area (b) of FIG. 6, a glass substrate 90 corresponding to the upper frame 2 is prepared.

By spot facing, the glass substrate 90 is formed with a depression 901 (corresponding to the depression 201 in FIG. 2), and a hole 902 (corresponding to the hole 202 in FIG. 2) is provided so as to reach the depression 901 from the surface of the glass substrate 90. As shown in the area (c) of FIG. 6, a photocathode terminal 92 corresponding to the photocathode terminal 21 in FIG. 2 is inserted and fixed into the hole 902, while the depression 901 is formed with a photocathode 91.

Figure 6:
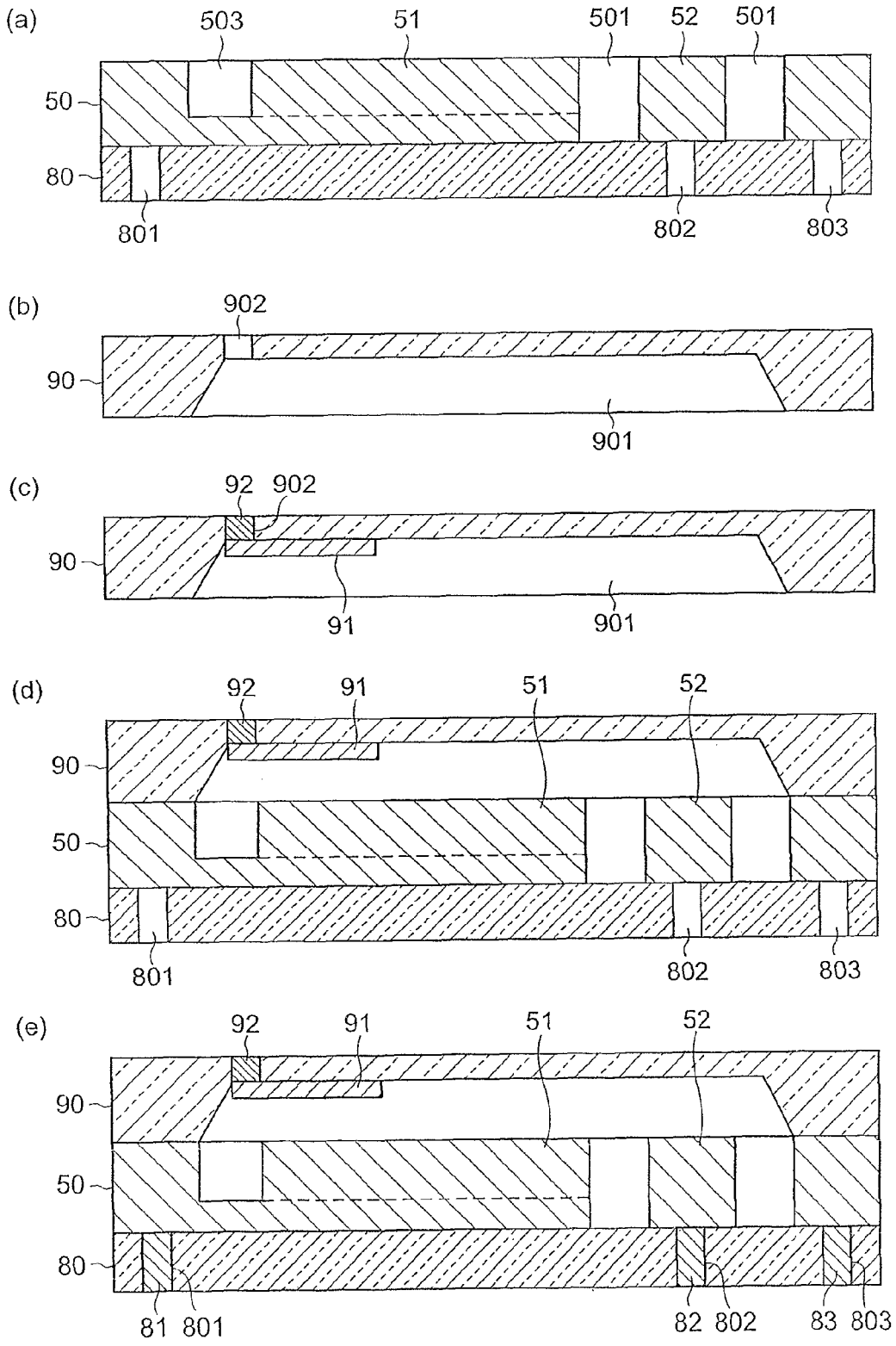
FIG. 6 is a (second) view for explaining the method of manufacturing the photomultiplier according to the first embodiment.

The silicon substrate 50 and glass substrate 80 having processed to the area (a) of FIG. 6 and the glass substrate 90 having processed to the area (c) in FIG. 6 are joined together by anodic bonding or diffusion bonding in a vacuum airtight state as shown in the area (d) of FIG. 6. Thereafter, a photocathode-side terminal 81, an anode terminal 82, an anode-side terminal 83 which correspond to the photocathode-side terminal 41, anode terminal 42, and anode-side terminal 43 in FIG. 2 are inserted and fixed into the holes 801, 802, and 803, respectively, whereby the state shown in the area (e) of FIG. 6 is obtained. Then, the resulting product is cut out into individual chips, whereby a photomultiplier having the structure shown in FIGS. 1 and 2 is obtained.

Second Embodiment

Figure 7:
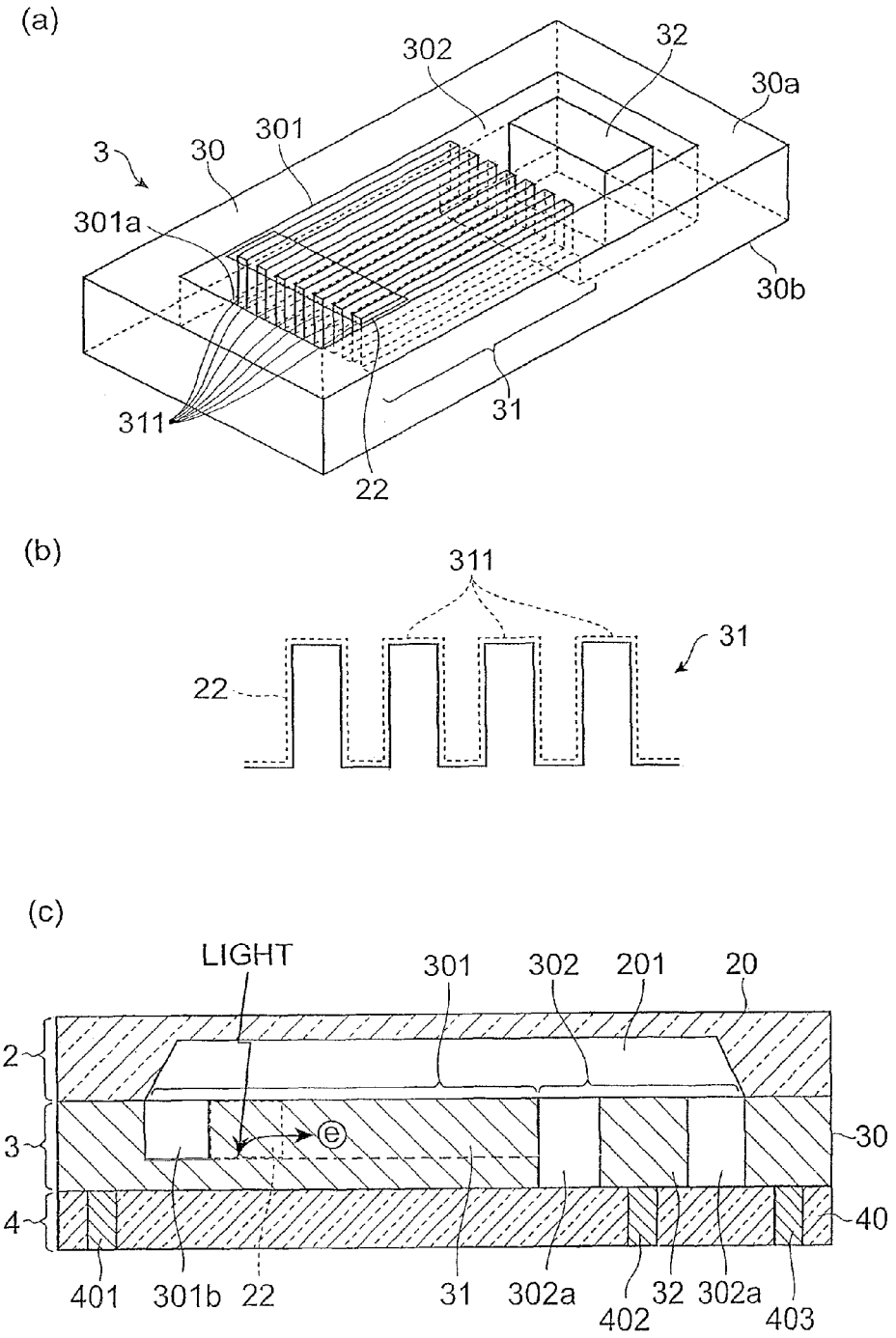
FIG. 7 is a view showing the structure of a second embodiment (reflection type) of the photomultiplier according to the present invention.

FIG. 7 is a view showing the structure of a second embodiment of the photomultiplier according to the present invention. The photomultiplier according to the second embodiment has the same structure as that of the photomultiplier according to the first embodiment except for the position at which the photocathode is arranged. Here, the area (a) in FIG. 7 shows a silicon substrate 30 corresponding to the side wall frame shown in FIG. 2 illustrating the assembling process of the first embodiment.

In the photomultiplier according to the second embodiment, the silicon substrate 30 is formed with a photocathode 22 at an end part positioned on the side opposite from the anode 32 in end parts of the electron multiplier section 31 as shown in the area (a) of FIG. 7. Specifically, as shown in the area (b) of FIG. 7, side faces of wall parts 311 defining grooves and the bottom part of grooves between the wall parts on the end pall of the electron multiplier section 31 on the side opposite from the anode 32 are formed with the photocathode 22.

Because of this configuration, the photocathode 22 having received the light transmitted through the glass substrate 20 constituting the upper frame 2 as a transmitting window emits photoelectrons toward the anode 32 in the photomultiplier according to the second embodiment. While the photoelectrons from the photocathode 22 propagate through the grooves toward the anode 32, they collide against side faces of the wall parts 311 and the bottom parts 301*a* between the opposing wall parts 311, thereby emitting secondary electrons. Electrons which are thus successively multiplied in a cascading manner reach the anode 32 (see the area (c) in FIG. 7). The area (c) in FIG. 7 shows a sectional view corresponding to FIG. 3 showing a cross-sectional structure of the first embodiment.

Third Embodiment

Figure 8:
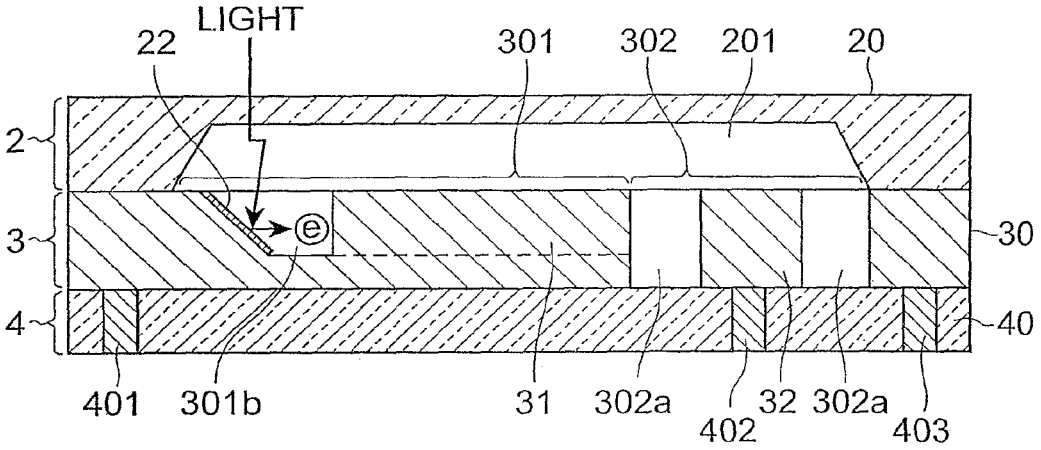
FIG. 8 is a view showing the structure of a third embodiment (reflection type) of the photomultiplier according to the present invention.

FIG. 8 is a view showing the structure of a third embodiment of the photomultiplier according to the present invention. The third embodiment is also a photomultiplier having a reflection-type photocathode with the same structure as that of the photomultiplier according to the first embodiment except for the structure in which the photocathode 22 is arranged.

As shown in FIG. 8, in the photomultiplier according to the third embodiment, the inner side face of the side wall frame 3 on the opposite side of the electron multiplier section 31 from the anode 32 is formed with the photocathode 22. This inner side face is inclined with respect to each of the upper frame 2 functioning as a transmitting window and the electron multiplier section 31. Forming the photocathode 22 on the inner side face yields a photomultiplier having the reflection-type photocathode.

Because of this configuration, the photocathode 22 having received the light transmitted through the glass substrate 20 constituting the upper frame 2 as a transmitting window emits photoelectrons toward the electron multiplier section 31 in the photomultiplier according to the third embodiment. While the photoelectrons from the photocathode 22 propagate through the grooves in the electron multiplier section 31 toward the anode 32, they collide against side faces of the wall parts 311 and the bottom parts 301*a* between the opposing wall parts 311, thereby emitting secondary electrons. Electrons which are thus successively multiplied in a cascading manner reach the anode 32. Here, FIG. 8 shows a sectional view corresponding to FIG. 3 showing a cross-sectional structure of the first embodiment.

Fourth Embodiment

In the photomultipliers of transmission type and reflection type according to the above-mentioned first to third embodiments, the electron multiplier section 31 arranged within the enclosure is integrally faulted while in contact with the silicon substrate 30 constituting the side wall frame 3. When the side wall frame 3 and the electron multiplier section 31 are in contact with each other, however, there is a possibility of the electron multiplier section 31 being affected by external noise through the side wall frame 3, thus lowering the detection accuracy.

Figure 9:
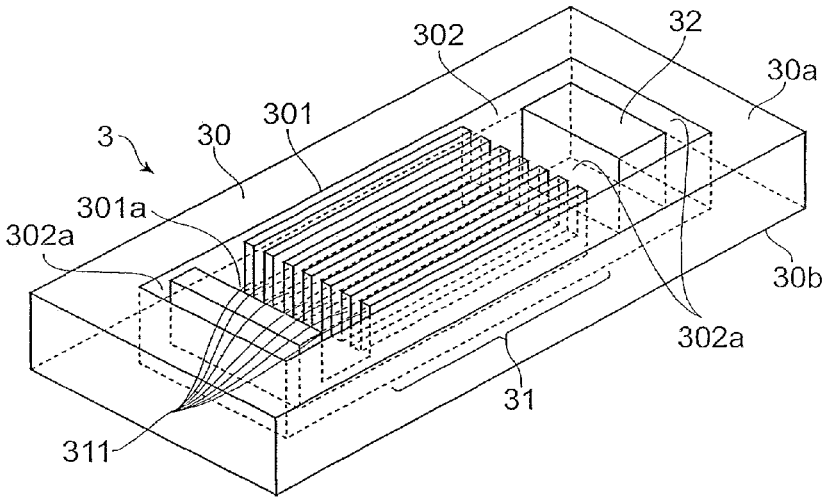
FIG. 9 is a view showing a fourth embodiment of the photomultiplier according to the present invention.
Figure 9:
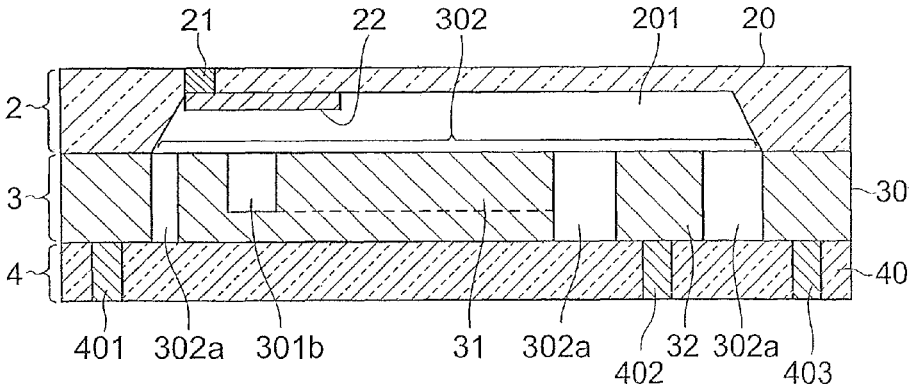

In the photomultiplier according to the fourth embodiment, the electron multiplier section 31 and anode 32 integrally formed with the side wall frame 3 are arranged on the flat part in the glass substrate 40 (lower frame 4) while in a state each separated by a predetermined distance from the side wall frame 3. Here, the area (a) in FIG. 9 shows a perspective view of the side wall frame in the fourth embodiment, whereas the area (b) in FIG. 9 shows a sectional view corresponding to FIG. 3 showing a cross-sectional structure of the first embodiment. As can also be seen from FIG. 9, the photomultiplier according to the fourth embodiment is a photomultiplier having a transmission-type photocathode with the same structure as that of the photomultiplier according to the first embodiment except that the electron multiplier section 31 and anode 32 each separated by a predetermined distance from the side wall frame 3 are fixed to the glass substrate 40 that is the lower frame 4.

Fifth Embodiment

Figure 10:
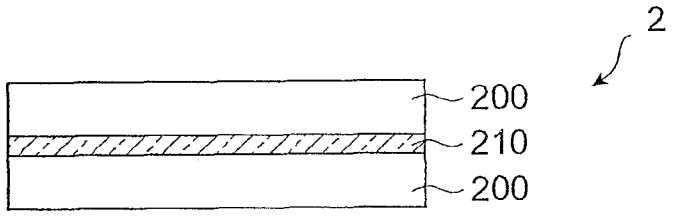
FIG. 10; is a (first) view for explaining a method of forming a transmitting window.
Figure 10:
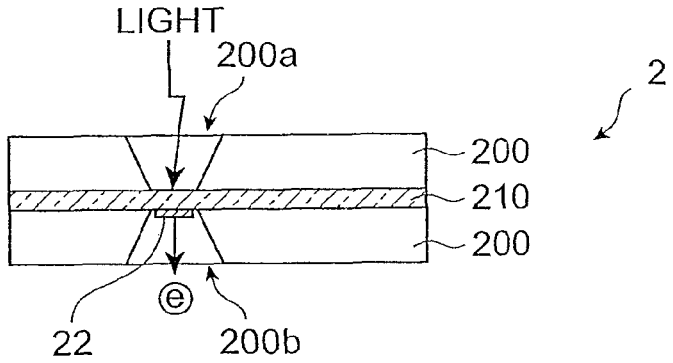
Figure 11:
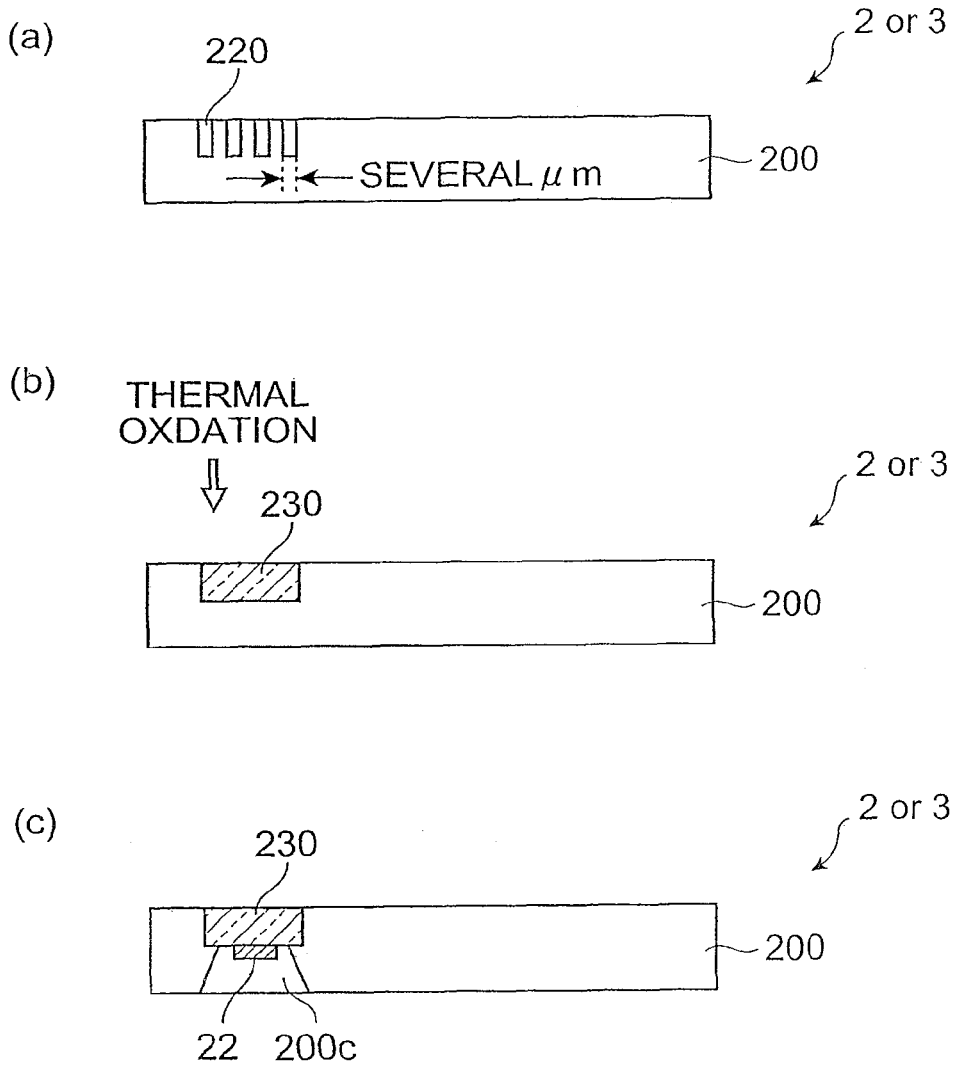
FIG. 11 is a (second) view for explaining the method of forming a transmitting window.
Figure 12:
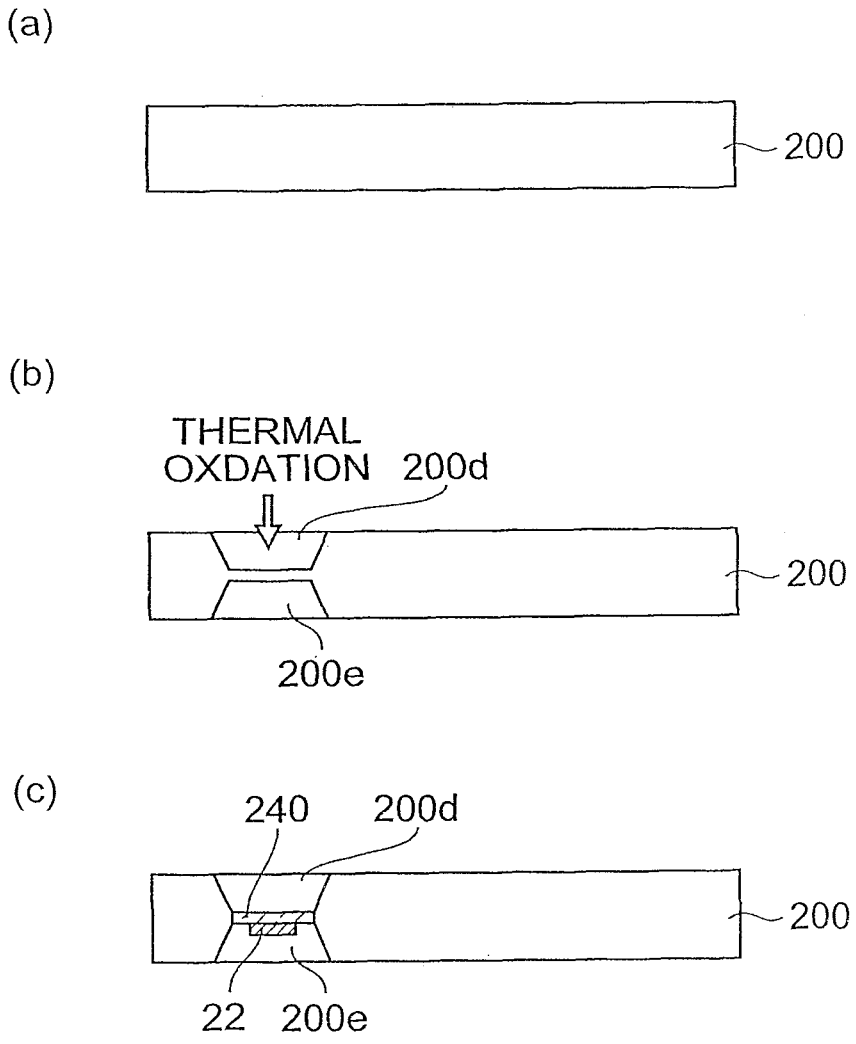
FIG. 12 is a (third) view for explaining the method of forming a transmitting window.

In each of the above-mentioned transmission-type and reflection-type photomultipliers according to the first to fourth embodiments, the upper frame 2 is constructed by the glass substrate 20, whereas the glass substrate 20 itself functions as a transmitting window. However, the upper frame 2 may be constructed by a silicon substrate as well. In this case, any of the upper frame 2 or side wall frame 3 is formed with a transmitting window. FIGS. 10 and 11 are views for explaining methods of forming a transmitting window in the upper frame 2 or side wall frame 3 comprised of a silicon material.

For example, FIG. 10 is a view showing a transmitting window producing process in the case where an SOI (Silicon On Insulator) substrate is employed as the upper frame 2. As shown in the area (a) of FIG. 10, the SOI substrate is obtained by forming a sputtered glass substrate 210 on a base silicon substrate 200, and thereafter joining an upper silicon substrate 200 onto the sputtered glass substrate 210 by anodic bonding. Then, as shown in the area (b) of FIG. 10, depressions 200*a*, 200*b* are formed by etching from both sides of the SOI substrate (the silicon substrates 200 positioned on both sides of the sputtered glass substrate 210) toward the sputtered glass substrate 210. A part of the sputtered glass substrate 210 exposed by the depressions 200*a*, 200*b* becomes a transmitting window. In the case of the transmission-type photomultiplier, the photocathode 22 is formed on a surface of the sputtered glass substrate 210 which becomes the inner side of the enclosure.

In the case where a silicon substrate 200 is employed alone as the upper frame 2, one face of the prepared silicon substrate 200 is initially formed with grooves 220 each having a width of several μm or less with an appropriate depth as shown in the area (a) of FIG. 11. These grooves may be formed like columns or meshes as seen from the front face of the silicon substrate 200. Then, as shown in the area (b) of FIG. 11, the area formed with the grooves in one face of the silicon substrate 200 is thermally oxidized, so as to glassify a part of the silicon substrate 200. On the other hand, as shown in the area (c) of FIG. 11, the other face of the silicon substrate 200 is etched to the glassified area, so as to form a depression 200*c*, thereby yielding a transmitting window. In the case of the transmission-type photomultiplier, the photocathode 22 is formed on the glassified area (transmitting window 230) exposed through the depression 200*c*.

For forming the transmitting window by thermally oxidizing the silicon substrate 200, methods other than the forming method shown in FIG. 11 may be employed. Namely, a transmitting window forming area of the silicon substrate 200 may be etched so as to attain a thickness of about several and this transmitting window forming area may be thermally oxidized, so as to be glassified. In this case, the silicon substrate 200 may be etched from either both sides or one side. Specifically, a silicon substrate 200 to become an upper frame is prepared (see the area (a) in FIG. 12), and is etched from both sides, so as to form depressions 200*d*, 200*e* (see the area (b) in FIG. 2). Here, the thickness of the transmitting window forming area is about several μm, whereas the etched area is thermally oxidized, so that a part of the silicon substrate 200 is glassified, whereby a transmitting window 240 is obtained. In the case of the transmission-type photomultiplier, the photocathode 22 is formed on the glassified area (transmitting window) exposed through the depression 200*e* (see the area (c) in FIG. 12).

Figure 13:
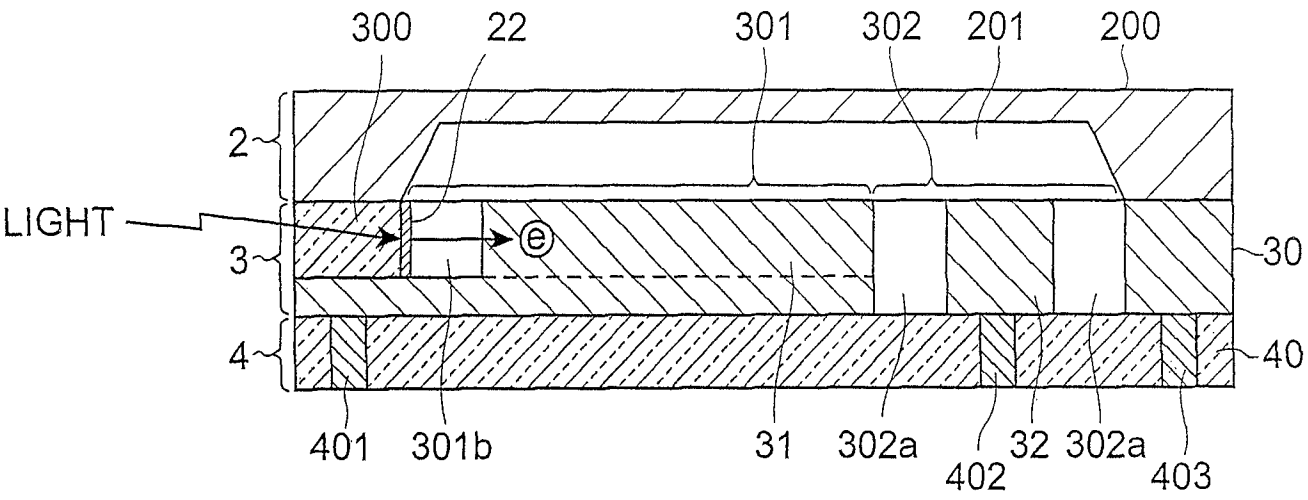
FIG. 13 is a view showing the structure of a fifth embodiment of the photomultiplier according to the present invention.

Thus formed transmitting window may also be provided in the side wall frame 3 comprised of a silicon material. FIG. 13 is a view showing the structure of a fifth embodiment of the photomultiplier according to the present invention. Here, FIG. 13 is a sectional view corresponding to FIG. 3 showing a cross-sectional structure of the photomultiplier according to the first embodiment.

The photomultiplier according to the fifth embodiment differs from the photomultipliers according to the first to fourth embodiments in that the upper frame 2 is constructed by a silicon substrate 200. The fifth embodiment has the same structure as that of the photomultiplier according to the first embodiment except that it is a transmission-type photomultiplier in which the side wall frame 3 is provided with a transmitting window 300 while the photocathode 22 is formed on the inside of the transmitting window 300.

In each of the above-mentioned embodiments, the silicon substrate and glass substrate are joined together by anodic bonding or diffusion bonding. Such anodic bonding or diffusion bonding can minimize troubles such as the occurrence of foreign matters at the time of welding and the like.

Figure 14:
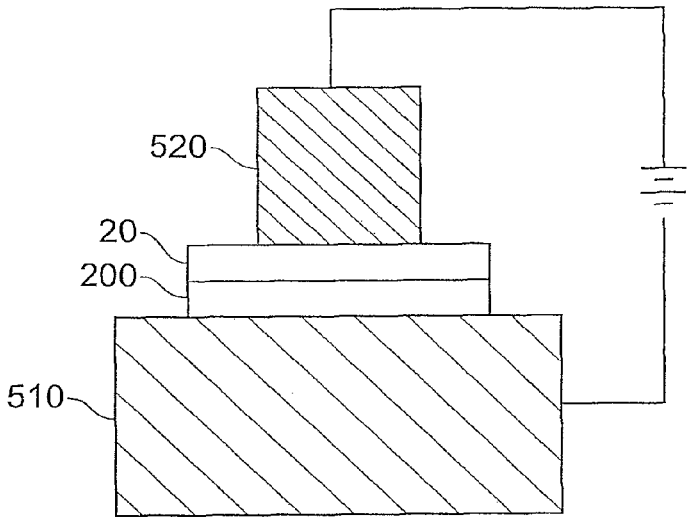
FIG. 14 is a view for explaining each of anodic bonding and diffusion bonding.
Figure 14:
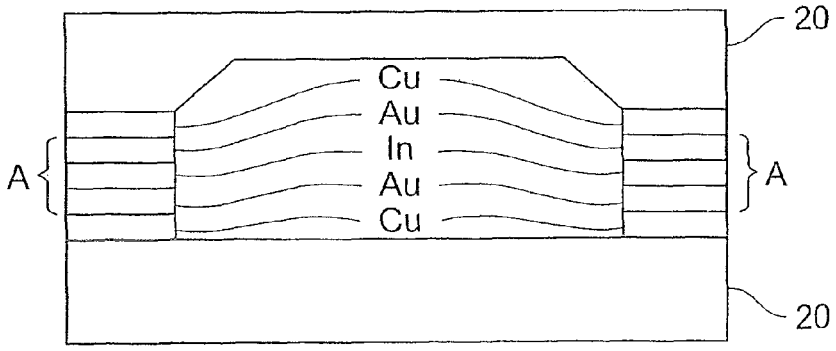

Specifically, anodic bonding is performed by an apparatus such as the one shown in the area (a) of FIG. 14. Namely, a silicon substrate 200 and a glass substrate 20 are successively placed on a metal pedestal 510, and a metal weight 520 is further mounted thereon. When a predetermined voltage is applied between the metal pedestal and the metal weight 520, the silicon substrate 200 and glass substrate 20 are closely joined together.

The silicon substrate 200 and glass substrate 20 can be joined together by diffusion bonding as well. The area (b) in FIG. 14 is a view for explaining diffusion bonding. As shown in the area (b) of FIG. 14, a metal layer in which Au, In, and Au films are successively laminated is arranged between a silicon substrate 200 and a glass substrate 20 each of which is formed with a Cu film at the junction part therebetween, and the silicon substrate 200 and glass substrate 20 are thermally pressed together at a relatively low temperature, whereby the silicon substrate 200 and glass substrate 20 are closely joined together. Diffusion bonding refers to a technique in which a plurality of metal layers which do not mix together at normal temperature are placed between members to be joined, and thermal energy is applied to the metal layers, whereby specific metal layers mix together (diffuse) and finally form an alloy, thus joining these members together.

The method of manufacturing a photomultiplier according to the present invention can manufacture not only the photomultiplier having the structure mentioned above, but also photomultipliers having various structures.

Figure 15:
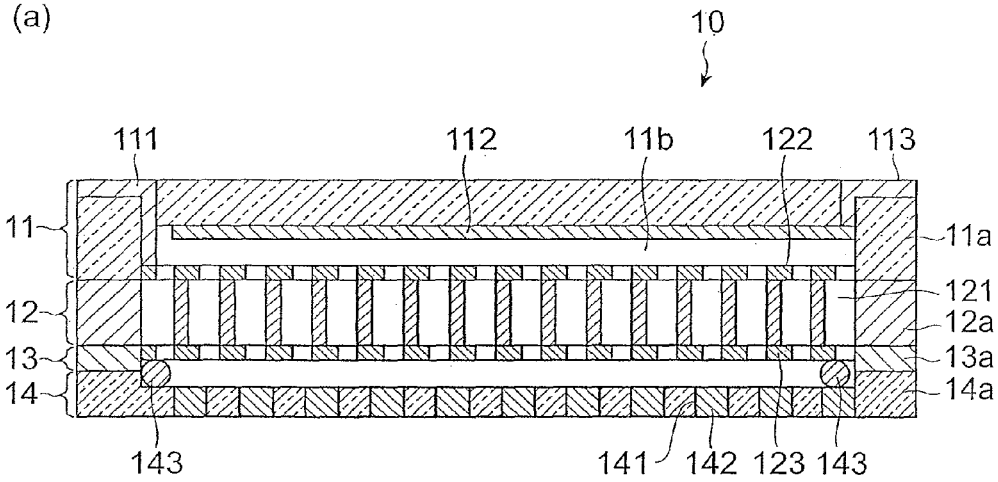
FIG. 15 is a view showing another structure of a photomultiplier which can be manufactured by the method of manufacturing a photomultiplier according to the present invention.
Figure 15:
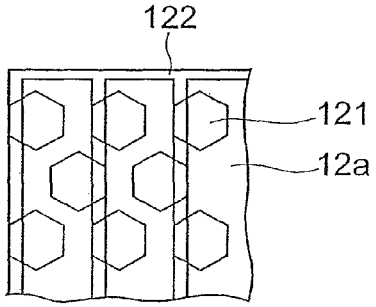

FIG. 15 is a view showing another structure of photomultiplier which can be manufactured by the manufacturing method of the present invention. FIG. 15 shows a cross-sectional structure of the photomultiplier 10 which can be manufactured by the manufacturing method according to the present invention. As shown in the area (a) of FIG. 15, the photomultiplier 10 is constructed by an upper frame 11, a side wall frame 12 (silicon substrate), a first lower frame 13 (glass member), and a second lower frame (substrate) which are anodically bonded together. The upper frame 11 is comprised of a glass material, whose surface opposing the side wall frame 12 is formed with a depression 11*b*. A photocathode 112 is formed over substantially the whole surface of the bottom part of the depression 11*b*. A photocathode electrode 113 giving a potential to the photocathode 112 and a surface electrode terminal 111 in contact with a surface electrode which will be explained later are arranged at one end and the other end of the depression 11*b*, respectively.

The side wall frame 12 is provided with a number of holes 121 parallel to the cylinder axis of the silicon substrate 12*a*. The inside of each hole 121 is formed with a secondary electron emitting surface. A surface electrode 122 and a back electrode 123 are arranged near opening parts at both ends of each hole 121, respectively. The area (b) in FIG. 15 shows the positional relationship between the holes 121 and surface electrodes 122. As shown in the area (b) of FIG. 15, the surface electrodes 122 are arranged so as to reach the holes 121. The same holds for the back electrodes 123 as well. The surface electrode 122 is in contact with a surface electrode terminal 111, whereas a back electrode terminal 143 is in contact with the back electrode 123. Therefore, a potential occurs in the side wall frame 12 axially of the holes 121, whereby photoelectrons emitted from the photocathode 112 advance downward through the holes 121 in the drawing.

The first lower frame 13 is a member for connecting the side wall frame 12 and second lower frame 14 to each other, and is anodically bonded (may be diffusion-bonded) to both of the side wall frame 12 and second lower frame 14.

The second lower frame 13 is constructed by a silicon substrate 14*a* provided with a number of holes 141. Anodes 142 are inserted and fixed into these holes 142, respectively.

In the photomultiplier 10 shown in FIG. 15, incident light from the upper side of the drawing is transmitted through the glass substrate of the upper frame 11, so as to be incident on the photocathode 112. In response to the incident light, the photocathode 112 emits photoelectrons toward the side wall frame 12. The emitted photoelectrons enter the holes 121 of the first lower frame 13. The photoelectrons having entered the holes 121 generate secondary electrons while colliding against the inner walls of the holes 121, and thus generated secondary electrons are emitted toward the second lower frame 14. The anodes 142 take out thus emitted secondary electrons as signals.

Figure 16:
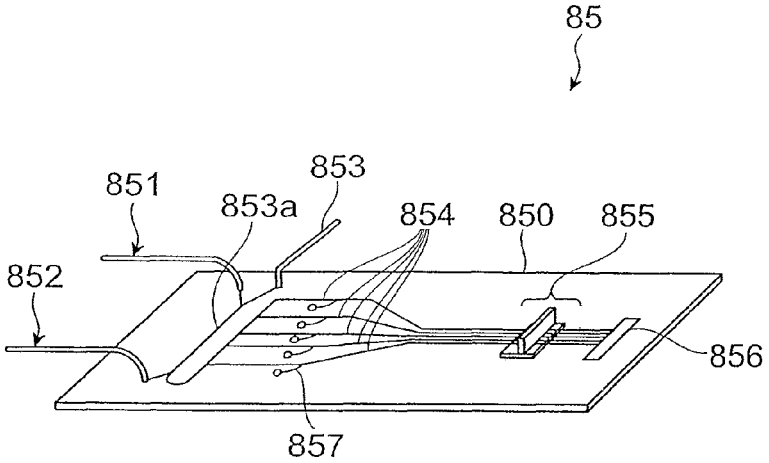
FIG. 16 is a view showing the structure of a detecting module employing the photomultiplier according to the present invention.
Figure 16:
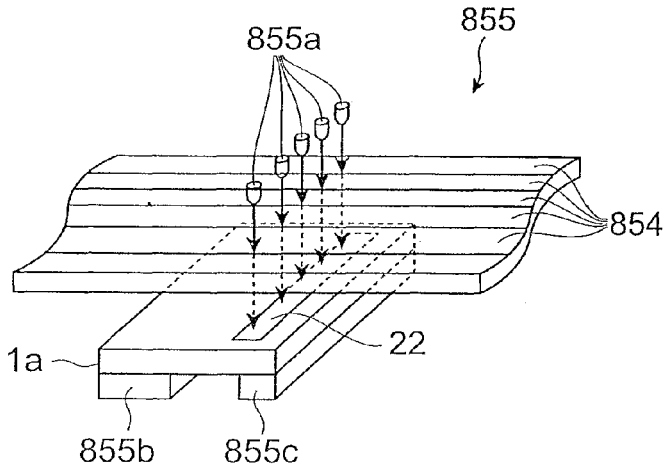

An optical module in which the embodiments of the photomultiplier according to the present invention are employed will now be explained. In the following, for simplification, an analyzing module employing the photomultiplier 1*a* according to the first embodiment will be explained. He area (a) in FIG. 16 is a view showing the structure of an analyzing module employing the photomultiplier 1*a* according to the first embodiment. The analyzing module 85 comprises a glass plate 850, a gas inlet duct 851, a gas exhaust duct 852, a solvent inlet duct 853, reagent mixing reaction paths 854, a detecting part 855, a waste reservoir 856, and reagent paths 857. The gas inlet duct 851 and gas exhaust duct 852 are provided for letting a gas to be analyzed into and out of the analyzing module 85. The gas introduced from the gas inlet duct 851 passes an extraction path 853*a* formed on the glass plate 850, and is let out from the gas exhaust duct 852. Therefore, when a solvent introduced from the solvent inlet duct 853 passes through the extraction path 853*a*, specific substances of interest (e.g., environmental hormones and fine particles) in the introduced gas if any can be extracted into the solvent.

The solvent having passed through the extraction path 853*a* is introduced into the reagent mixing reaction paths 854 while containing the extracted substances of interest. There are a plurality of reagent mixing reaction paths 854, whereas their corresponding reagents are introduced from the respective reagent paths 857, so as to be mixed with the solvent. The solvents mixed with the reagents advance through the reagent mixing reaction paths 854 toward the detecting part 855 while effecting reactions. The solvents having completed the detection of substances of interest in the detecting part 855 are discharged to the waste reservoir 856.

The structure of the detecting part 855 will be explained with reference to the area (b) in FIG. 16. The detecting part 855 comprises a light-emitting diode array 855*a*, a photomultiplier 1*a*, a power supply 855*c*, and an output circuit 855*b*. The light-emitting diode array 855*a* is provided with a plurality of light-emitting diodes corresponding to the respective reagent mixing reaction paths 854 of the glass plate 850. Pumping light (indicated by solid arrows in the drawing) emitted from the light-emitting diode array 855*a* is introduced into the reagent mixing reaction paths 854. Solvents which may contain substances of interest flow through the reagent mixing reaction paths 854. After the substance of interest reacts with the reagents in the reagent mixing reaction paths 854, the reagent mixing reaction paths 854 corresponding to the detecting part 855 are irradiated with the pumping light, whereby fluorescence or transmitted light (indicated by broken arrows in the drawing) reaches the photomultiplier 1*a*. The fluorescence or transmitted light irradiates the photocathode 22 of the photo multiplier 1*a*.

Since the photomultiplier 1*a* is provided with an electron multiplier section having a plurality of grooves (corresponding to 20 channels, for example) as has already been explained, it can detect at which position (in which reagent mixing reaction path 854), the fluorescence or transmitted light has changed. The output circuit 855*b* outputs the result of detection. The power supply 855*c* is a power source for driving the photomultiplier 1*a*. A thin glass sheet (not depicted) is placed on the glass plate 850, so as to cover the extraction path 853*a*, reagent mixing reaction paths 854, reagent paths 857 (excluding their reagent injecting parts), and the like except for junctions of the gas inlet duct 851, gas exhaust duct 852, and solvent inlet duct 853 with the glass plate 850 and reagent injecting parts of the waste reservoir 856 and reagent paths 857.

In the present invention, as in the foregoing, the electron multiplier section 31 is formed by processing grooves in the silicon substrate 30*a*, while the silicon substrate 30*a* is joined to the glass substrate 40*a* by anodic bonding or diffusion bonding, thus forming no vibrating parts. Therefore, the photomultipliers according to each of the above-described embodiments are excellent in resistances to vibrations and shocks.

Since the anode 32 is anodically bonded or diffusion-bonded to the glass substrate 40*a*, there are no metal droplets at the time of welding. Therefore, the photomultipliers according to each of the embodiments have improved electric stability and resistances to vibrations and shocks. The anode 32 is anodically bonded or diffusion-bonded by the whole lower face thereof to the glass substrate 40*a*, and thus does not vibrate upon shocks and vibrations. Therefore, the photomultipliers according to each of the embodiments have improved electric stability and resistances to vibrations and shocks.

In the manufacture of the photomultipliers, there is no need to assemble an inner structure, so that the handling is easy, whereby the working time is short. They can easily attain a smaller size, since the enclosure (vacuum envelope) constructed by the upper frame 2, side wall frame 3, and lower frame 4 is integrated with the inner structure. Since there are no individual components inside, electrical and mechanical bonds are unnecessary.

Since no special members are needed for sealing the enclosure constructed by the upper frame 2, side wall frame 3, and lower frame 4, sealing in a wafer size is possible as in the photomultiplier according to the present invention. Since a plurality of photomultipliers are obtained by dicing after sealing, they can be produced inexpensively by easy operations.

Because of sealing by anodic bonding or diffusion bonding, no foreign matters occur. Therefore, the photomultipliers have improved electric stability and resistances to vibrations and shocks.

In the electron multiplier section 31, electrons are multiplied in a cascading manner while colliding against side walls of a plurality of grooves constructed by the wall parts 311. Therefore, it is simple in structure and does not need a large number of components, and thus can easily be made smaller.

The analyzing module 85 employing the photomultiplier according to each of the embodiments having the structures mentioned above can detect minute particles. It can continuously perform the extraction, reaction, and detection.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The photomultiplier according to the present invention is employable in various detection fields which need to detect weak light.

The invention claimed is:

1. A photomultiplier, comprising:

an enclosure having an internal space kept in a vacuum state and having at least a part constituted by a silicon substrate, the silicon substrate having an inner surface and an outer surface which oppose each other and define a thickness of the enclosure, the inner surface of the silicon substrate facing the internal space of the enclosure, the outer surface of the silicon substrate being exposed to external of the enclosure;

a photocathode accommodated in the enclosure;

an anode accommodated in the enclosure;

an electron multiplying section accommodated in the enclosure, the electron multiplying section cascade-multiplying electrons emitted from the photocathode in a direction from one end thereof to the other end thereof, the other end of the electron multiplying section being positioned at a side where the anode is arranged; and a glass window constituting a part of the enclosure and configured to introduce light from the external of the enclosure to the photocathode, wherein the electron multiplying section is arranged on an inner surface of the enclosure which defines the internal space of the enclosure, and, wherein the glass window has an inner surface and an outer surface opposing the inner surface thereof, the inner surface of the glass window facing the internal space of the enclosure, the outer surface of the glass window being exposed to the external of the enclosure, and wherein the glass window is supported by the silicon substrate while the glass window is arranged within a space sandwiched by a first plain including the outer surface of the silicon substrate and a second plain including the inner surface of the silicon substrate.

2. The photomultiplier according to claim 1, wherein the outer surface of the glass window corresponds to the outer surface of the silicon substrate.

3. The photomultiplier according to claim 2, wherein the inner surface of the glass window corresponds to the inner surface of the silicon substrate.

4. The photomultiplier according to claim 1, wherein both the inner and outer surfaces of the glass window are positioned within the space sandwiched by the first and second plains.

5. The photomultiplier according to claim 1, wherein the enclosure comprises a first frame, a second frame opposing the first frame, and a side wall frame provided between the first and second frames while surrounding the electron multiplying section, and the first frame includes the silicon substrate.

6. The multiplier according to claim 1, wherein the silicon substrate has a first depressed portion having an opening edge provided on the inner surface thereof, and wherein a bottom surface of the first depressed portion is constituted by the inner surface of the glass window.

7. The photomultiplier according to claim 6, wherein the outer surface of the silicon substrate corresponds to the outer surface of the glass window.

8. The photomultiplier according to claim 6, wherein the glass window includes a glassified area of the silicon substrate obtained by thermal oxidization.

9. The photomultiplier according to claim 6, wherein the photocathode is provided on the inner surface of the glass window while being accommodated in the first depressed portion of the silicon substrate.

10. The photomultiplier according to claim 6, wherein the silicon substrate comprises: a first silicon layer having an inner surface corresponding to the inner surface of the silicon substrate and an outer surface opposing the inner surface thereof; a second silicon layer having an inner surface and an outer surface opposing the inner surface thereof; and a glass layer provided between the outer surface of the first silicon layer and the inner surface of the second silicon layer, the glass layer including the glass window, wherein the outer surface of the second silicon layer corresponds to the outer surface of the silicon substrate, and the second silicon layer has a second depressed portion having an opening edge provided on the outer surface of the second silicon layer, and wherein a bottom surface of the second depressed portion is constituted by the outer surface of the glass window.

11. The photomultiplier according to claim 10, wherein the photocathode is provided on the inner surface of the glass window while being accommodated in the first depressed portion of the silicon substrate.

12. The photomultiplier according to claim 6, wherein the silicon substrate has a second depressed portion having an opening edge provided on the outer surface thereof, and wherein a bottom surface of the second depressed portion is constituted by the outer surface of the glass window.

13. The photomultiplier according to claim 1, wherein the enclosure comprises a first frame, a second frame opposing the first frame, and a side wall frame provided between the first and second frames while surrounding the electron multiplying section, and the side wall frame includes the silicon substrate.

14. The photomultiplier according to claim 13, wherein the glass window is provided at a position of the side wall frame where faces the one end of the electron multiplying section.

* * * * *